US005390015A

United States Patent [19]

Nagame et al.

[11] Patent Number: 5,390,015

[45] Date of Patent: Feb. 14, 1995

[54] CARRIER REMOVAL IN AN ELECTROPHOTOGRAPHIC IMAGE FORMATION METHOD

[75] Inventors: Hiroshi Nagame; Narihito Kojima, both of Numazu, Japan

[73] Assignee: Ricoh Company, Ltd., Tokyo, Japan

[21] Appl. No.: 101,001

[22] Filed: Aug. 3, 1993

[30] Foreign Application Priority Data

Aug. 3, 1992 [JP] Japan ..... 4-226440

[51] Int. Cl.[6] ..... G03G 21/00

[52] U.S. Cl. ..... 355/305; 355/77; 355/296; 355/301

[58] Field of Search ..... 355/215, 296, 297, 298, 355/305, 301, 268, 77; 430/100

[56] References Cited

U.S. PATENT DOCUMENTS 5,147,751 9/1992 Kojima et al. .

*Primary Examiner*—A. T. Grimley
*Assistant Examiner*—Sandra L. Brasé
*Attorney, Agent, or Firm*—Oblon, Spivak, McClelland, Maier & Neustadt

[57] ABSTRACT

In an electrophotographic image formation method including the steps of uniformly charging a photoconductor, exposing the charged photoconductor to a digitally-processed light image to form a latent electrostatic image, and developing the latent electrostatic image by reverse development with a dry type two-component developer composed of a carrier and a toner to a toner image, transferring the toner image to a transfer sheet, and cleaning the photoconductor to remove the remaining developer from the surface of the photoconductor, a carrier removing device including a magnet with a magentic flux density of 400 to 2000 Gauss is provided between the development step and the cleaning step.

8 Claims, 3 Drawing Sheets

CARRIER REMOVAL IN AN ELECTROPHOTOGRAPHIC IMAGE FORMATION METHOD

BACKGROUND OF THE INVENTION

1. Field of the Invention

The present invention relates to an electrophotographic image formation method capable of forming high quality images by developing latent electrostatic images formed on a photoconductor with a two-component type developer comprising a carrier and a toner for an extended period of time, by preventing the photoconductor from being scratched by the carrier of the two-component type developer, which remains on the surface of the photoconductor after the development of latent electrostatic images, even though the amount of the remaining carrier is slight.

2. Discussion of Background

Inorganic photoconductive materials such as selenium (Se), amorphous silicon (a-Si), and cadmium sulfide (CdS) are conventionally used as electrophotographic photoconductors. Recently, however, organic photo-conductors comprising an organic photoconductive material are widely used because of the advantages of organic photoconductors over inorganic photoconductive materials that the cost is low, no pollution problems are caused, and the electrophotographic characteristics are excellent.

Organic photoconductors have a hardness in the range of about 20 to 40 kg/cm$^2$ because of the organic photoconductive materials employed therein, and therefore the mechanical durability thereof is low. Therefore, when such an organic photoconductor is used without particular treatment in electrophotographic copying machines, or in image formation apparatus for laser printers, the organic photoconductor will have be exchanged with a new organic photoconductor whenever about 50,000 to 100,000 copies have been made by use of the organic photoconductor. Therefore, many proposals have been made for increasing the hardness of a top layer of such an organic photoconductor to improve the abrasion resistance thereof.

One of the representative proposals for improving the abrasion resistance of an organic photoconductor is to provide a protective thin layer with high hardness as an overcoat layer on a photoconductive layer of the organic photoconductor.

Such a protective layer must not impair the optical characteristics and electrical characteristics of the photoconductor and must have excellent mechanical and chemical characteristics.

One of the most suitable protective layer for an organic photoconductor for use in the present invention is an amorphous carbon film (i.e. a-C film), which is also referred to as diamond-like carbon film. This amorphous carbon film is fabricated by vacuum film formation methods, such as the plasma CVD method, the light CVD method, and the sputtering method, by use of a hydrocarbon gas such as methane, ethane, ethylene, butane or butadiene, together with any of hydrogen, oxygen, fluorine, and nitrogen gases when necessary.

When a photoconductive layer is coated with the above-mentioned a-C film, it is necessary that the temperature of a substrate for the photoconductive layer must not be above room temperature in view of the glass transition temperature (Tg) of the photoconductive layer. By the selection of an appropriate gas from the above-mentioned various gases at the formation of the protective layer, and by appropriately setting the conditions for the formation of the protective layer, it is possible to fabricate a protective layer with excellent electro-photographic characteristics and mechanical abrasion resistance.

In the above-mentioned organic photoconductors with hard protective layers, and inorganic photoconductors, some hard foreign materials occasionally enter between a photoconductor and a cleaning member (or cleaning blade) for removing a developer from the surface of the photoconductor.

If this takes place, scratches with a thickness of several micrometers to several ten micrometers are formed in the surface of the photoconductor. Such scratches formed in the photoconductor may produce abnormal images such as non-printed lines or black lines in copies, thereby lowering the image quality obtained, depending upon the value of the surface potential at the photoconductor, and shorten the life of the photoconductor.

More specifically, electrophotographic image formation is carried out by uniformly charging a photoconductor to a predetermined polarity (positive or negative), for instance, with a potential of 500 volts to 1200 volts, projecting an original image processed in the form of digital signals to the charged photoconductor to form a latent electrostatic image corresponding to the original image, and developing the latent electrostatic image to a visible toner image by a two-component developer comprising a toner and a carrier.

In the above development process, (1) when the potential of the charged photoconductor is excessively high, (2) when the difference in the potential between a light area and a dark area in the original image is excessive, (3) when ultramicro particles are contained in the carrier, or (4) when a carrier with deteriorated chargeability is contained in the developer, the carrier is deposited not only on the image area, but also on the background of the latent electrostatic image, or non-printed portions are formed in the developed toner image.

Furthermore, when the carrier is deposited on a photoconductor and is transported up to a cleaning section for cleaning the photoconductor after the development of the latent electrostatic image, and for instance, a rubber blade is used as a cleaning member in the cleaning section, the carrier enters between the cleaning blade and the photoconductor, and scratches the surface of the photoconductor. When the surface of the photo-conductor is scratched, the image quality obtained is lowered as mentioned previously.

The deposition of the carrier on the photoconductor can be decreased to some extent by decreasing the charging potential of the photoconductor, but there is a limit to the decreasing of the charging potential of the photoconductor in practice, so that the deposition of the carrier on the photoconductor cannot be completely avoided.

SUMMARY OF THE INVENTION

It is therefore an object of the present invention is to provide an electrophoto-graphic image formation method capable of forming high quality images by developing latent electrostatic images formed on a photoconductor with a two-component type developer comprising a carrier and a toner for an extended period of time, by preventing the photoconductor from being scratched with the carrier of the two-component type developer.

The above object of the present invention can be achieved by an electrophotgraphic image formation method comprising the steps of: (a) uniformly charging a photoconductor to a predetermined polarity, the photoconductor comprising an electroconductive support, an organic photoconductive layer formed on the electroconductive support, and a protective layer comprising carbon formed on the organic photoconductive layer, (b) applying a digitally-processed light image corresponding to an original image to the photoconductor, with the potential of an image area of the original image being reversed with respect to the potential of a non-image area of the original image, thereby forming a latent electrostatic image corresponding to the original image on the photoconductor, (c) performing reverse development of the latent electrostatic image formed on the photoconductor by use of a two-component developer comprising a carrier and a toner to form a visible toner image on the photoconductor, and (d) cleaning the photoconductor after the completion of the reverse development for the formation of the visible toner images, wherein at least one carrier removing means for removing the carrier by magnetic attraction with a magnetic flux density of 400 to 2000 Gauss is provided between the step of performing the reverse development and the step of cleaning the photoconductor.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 1(*b*) is a schematic cross-sectional view of another example of an electrophotographic photoconductor for use in the present invention;

DETAILED DESCRIPTION OF THE PREFERRED EMBODIMENTS

Figure 1A:
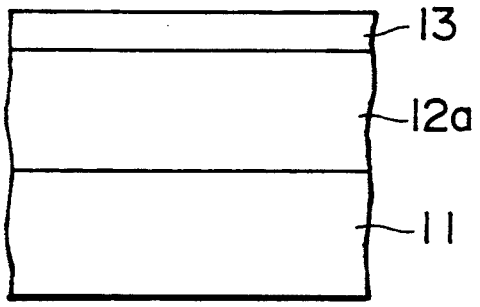
FIG. 1(*a*) is a schematic cross-sectional view of an example of an electrophotographic photoconductor for use in the present invention.

It is preferable that an electrophotographic photoconductor for use in the present invention have a protective layer made of an amorphous carbon film with a Knoop hardness of 200 kg/cm$^2$ or more, and a thickness of 1.0 to 0.5$\mu$m.

In the present invention, carrier-removing means for removing a carrier deposited on the surface of a photoconductor is disposed between (a) a development unit for developing latent electrostatic images formed on the photoconductor to visible toner images by a developer and (b) a cleaning unit for cleaning the surface of the photoconductor by removing the developer which remains thereon.

It is preferable to use as such carrier removing means a carrier removing unit comprising a rotary sleeve with an inner magnet built in, and a carrier-transportation preventing member for preventing the carrier from entering between the photoconductor and a cleaning member in the cleaning unit.

The carrier-transportation preventing member is in contact with the surface of the rotary sleeve and extends in the longitudinal direction of the rotary sleeve, so that the carrier deposited on the rotary sleeve is scraped off therefrom by the carrier-transportation preventing member.

Examples of hard foreign materials which may enter between the photoconductor and the cleaning blade include paper dust from copy paper, which contains talc and clay, a carrier of a dry type two-component developer, lubricating agents, aluminum dust which is formed when assembling various electric devices in electrophotographic copying machines, and solidified toner particles.

The carrier occupies 90% or more of the above-mentioned hard foreign materials which scratch the surface of the photoconductor.

As mentioned previously, according to the present invention, a carrier of a two-component developer is prevented from entering between the photoconductor and a cleaning member of a cleaning unit. Such a carrier is usually in the form of substantially spherical particles with a particle size of about 100$\mu$m or in the form of particles without a specific shape, comprising as the main component magnetic particles made of iron or iron oxide, with a coating layer on each carrier particle when necessary for improvement of the characteristics of the carrier.

In order to develop latent electrostatic images formed on a photoconductor to visible toner images, there are two methods, an ordinary development method and a reverse development method.

In the ordinary development method, electrically charged portions in the latent electrostatic images correspond to image areas, so that the electrically charged portions are developed with a developer.

In the reverse development method, the potentials of charged portions and non-charged portions (corresponding to exposed portions) are reversed in such a manner that the potential of the portions to be developed is set at a low level which is on a nearly zero volt side.

In the former development method, when a photoconductor with a large residual potential is used, toner deposition on the background sensitively takes place, and when scratches are formed in the surface of the photoconductor, the decrease image density tends to be drastically decreased.

In contrast, in the latter development method, even when scratches are formed in the surface of the photoconductor, the decrease in image density, which is caused when scratches are formed in the photoconductor and the charging potential thereof is decreased, is less than that in the case of the former development method, so that as long as the scratches are not excessive, and the lowering of the charging potential does not take place, toner deposition on the background does not take place easily. In other words, in comparison with the former development method, toner deposition on the background occurs less in the latter development method.

For the above reasons, in the present invention, the latter reverse development is employed.

In comparison with inorganic photoconductors, organic photoconductors are more easily scratched. This problem, however, can be solved by providing a carbonbased protective layer on a photoconductive layer to obtain such a durability that makes it possible to make about 500,000 copies.

However, when such a protective layer is provided on a photoconductive layer, the residual potential of the photoconductive layer tends to be built up. In view of this problem, the reverse development is advantageous over the ordinary development method.

However, in view of the deposition of a carrier on the surface of a photoconductor, the reverse development is not always advantageous over the ordinary development.

Specifically, for instance, when a negatively-chargeable photoconductor is charged to a potential of −900 volts, and the charge photoconductor is exposed to a digitally-processed image to produce (a) dark areas with a potential of −860 volts, and (b) light areas with a potential of −250 volts. The thus formed latent electrostatic images are developed by the reverse development with a negatively charged toner, with a development bias voltage set at −700 volts, whereby the toner is deposited in the light areas, and the latent electrostatic images are developed to visible toner images. In this reverse development, the toner is deposited in the light areas with a potential of −250 volts, while the carrier is deposited in the dark areas with a potential of −860 volts, which are larger than the light areas. In other words, a large amount of the carrier is deposited in the dark areas which correspond to the background of the developed images. Therefore the deposited carrier has significant adverse effects not only on the image quality, but also on the photoconductor employed.

In contrast, in the ordinary development, toner is deposited in the areas with a potential of −860 volts, while the carrier is deposited in the areas with a potential of −250 volts. In this case, even if the carrier is deposited in the areas with a potential of −250 volts, the amount of the deposited carrier is small because of the low potential of the area, so that the effects of the deposited carrier on the image quality and the photoconductor are slight.

Figure 1B:
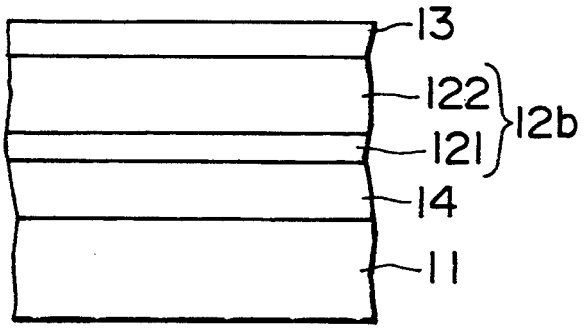

With reference to FIGS. 1(*a*) and 1(*b*), organic electrophotographic photoconductors for use in the electrophotographic image formation method of the present invention will now be explained.

FIG. 1(*a*) and FIG. 1(*b*) respectively show a cross-sectional view of a single-layered type organic photoconductor, and a cross-sectional view of a function-separated laminated-type photoconductor.

In FIG. 1(*a*), reference numeral 11 indicates an electroconductive support; reference numeral 12*a*, a photoconductive layer; and reference numeral 13, a protective layer.

In FIG. 1(*b*), reference numeral 11 indicates an electroconductive support; reference numeral 14, an undercoat layer; reference numeral 12*b*, a photoconductive layer which comprises a charge generating layer (CGL) 121 and a charge transport layer (CTL) 122; and reference numeral 13, a protective layer.

In the photoconductive layer 12*b* of the function-separating type photoconductor shown in FIG. 1(*b*), the laminating order of the CGL 121 and the CTL 122 may be reversed, and in such a case, the chargeability of the photoconductor is changed, for example, from positive chargeability to negative chargeability or vice versa.

The protective layer 13 for the photoconductive layer 12*a* or 12*b* is an important layer, which determines the mechanical characteristics of the photoconductor. It is preferable that the protective layer 13 be made of an amorphous carbon film.

Such an amorphous carbon film serving as the protective layer 13 can be formed on the photoconductive layer 12*a* or 12*b*, using hydrocarbon gases in a plasma state. In the case where the glass transition temperature of the photoconductive layer 12 ranges from about 70°to 120° C., it is necessary to set the temperature of the photoconductive layer 12 at about room temperature in the course of the formation of the protective layer 13, with the temperature rise during the film formation taken into consideration.

The protective layer 13 has an amorphous structure in which a diamond structure, a graphite structure and a polymer structure are united together. By changing the film formation conditions for the protective layer 13, the construction of the above-mentioned three structures and the relative ratios thereof in the protective layer 13 can be changed, whereby the transmittance, hardness and electrical resistivity of the protective layer 13 can be largely changed.

It is preferable that the protective layer 13 made of an amorphous carbon film have a Knoop hardness of 200 kg/mm$^2$ or more, and a thickness in the range of from 1.0 to 5.0μm, more preferably in the range of from 1.0 to 3.0μm. When the hardness and the thickness of the protective layer 13 are within the above respective ranges, not only the protective layer 13 is not scratched in the course of repeated copying operations owing to the improved mechanical durability of the photoconductor, but also there is no practical problem of decreasing the transmittance and increasing the electrical resistivity of the photoconductor. For instance, an organic electrophotographic photoconductor provided with an amorphous carbon film with a Knoop hardness of about 400 kg/mm$^2$ and a thickness of about 1.5μm is not worn at all even after the making of 100,000 or more copies.

Figure 2:
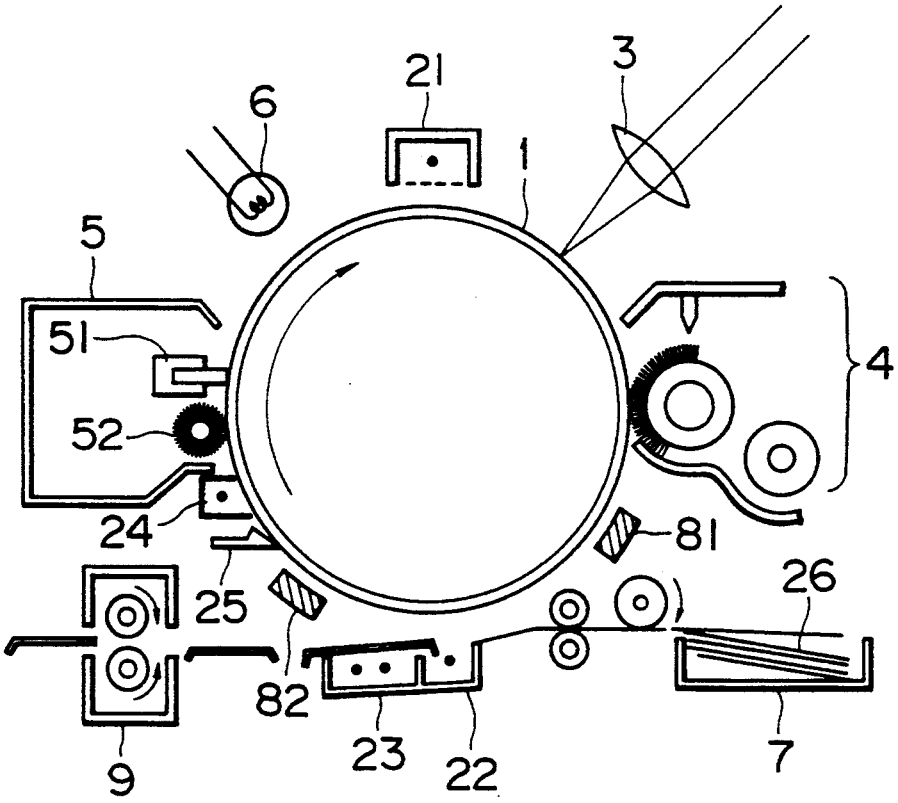
FIG. 2 is a schematic cross-sectional view of an electrophotographic copying machine for use in the present invention.

FIG. 2 is a schematic cross-sectional view of an example of an electrophotographic copying machine for use in the present invention. In FIG. 2, reference numeral 1 indicates an electrophotographic photoconductor drum; reference numeral 21, a charger; reference numeral 3, an image exposure system; reference numeral 4, a development unit; reference numeral 22, an image transfer charger; reference numeral 23, a transfer sheet separation charger; reference numeral 24, a quenching charger; reference numeral 25, a transfer sheet separation pawl; reference numeral 5, a cleaning unit; reference numeral 51, a cleaning blade; reference numeral 52, a cleaning roller; reference numeral 6, a quenching lamp; reference numeral 7, a tray for holding image transfer sheets 26; reference numeral 9, an image fixing unit; and reference numerals 81 and 82, carrier-removing units for removing a carrier deposited on the surface of the photoconductor drum 1.

In the electrophotographic copying machine shown in FIG. 2, the photoconductor drum 1 is rotated in the direction of the arrow, and is uniformly charged so as to have a surface potential, for instance, in the range of −600 volts to −900 volts during the rotation of the photoconductor drum 1 by the charger 21.

A light image is then projected onto the surface of the uniformly charged photoconductor drum 1 by the image exposure system 3, so that a latent electrostatic image is formed on the surface of the photoconductor drum 1.

The thus formed latent electrostatic image is developed to a visible toner image with a dry type two-component developer comprising a carrier and a toner by the development unit 4.

An image transfer sheet 26 supplied from the tray 7 is superimposed on the above toner image formed on the photoconductor drum 1, and the toner image is transferred to the image transfer sheet 26 by the image transfer charger 22.

The image transfer sheet 26 which bears the transferred toner image is then separated from the photoconductor drum 1 by the transfer sheet separation charger 23 and the transfer sheet separation pawl 25, and is then transported into the image fixing unit 9, so that a hard copy is made.

The developer remaining on the photoconductor drum 1 is removed from the surface of the photoconductor drum 1 by the quenching charger 24 and the cleaning unit 5, and the surface potential of the photoconductor drum 1 is substantially made zero by the quenching lamp 6.

As mentioned previously, when there is provided no carrier-removing means such as the carrier-removing units 81 and 82, the carrier contained in the developer which remains on the photoconductor drum 1, and other hard foreign materials enter between the photoconductor drum 1 and the cleaning blade 51, so that the surface of the photoconductor drum 1 is scratched by the carrier and hard foreign materials.

According to the present invention, however, at least one carrier-removing means (such as the carrier-removing unit 81 or 82) comprising a magnetic material, with a magnetic flux density of 400 to 2000 Gauss, is provided between the development unit 4 and the cleaning unit 5 as illustrated in FIG. 2. The carrier-removing means extends in the direction parallel to the generating line of the photoconductor drum 1 (i.e. in parallel to the axis of the photoconductor drum 1) with a space of about 2 to 5 mm between the surface of the photoconductor drum 1 and the carrier-removing means.

The specific value of the magnetic flux density of the carrier-removing means is appropriately set in accordance with the surface potential of the charged photoconductor drum 1, the location of the photoconductor drum 1, and the space for the photoconductor drum 1, the size of the magnetic material employed in the carrier-removing means, the amount of the carrier to be deposited on the photoconductor drum 1 for each image transfer sheet, the location of the incorporation of the carrier-removing means, and other factors. Usually a magnetic material with a magnetic flux density in the range of 600 to 1500 Gauss is disposed with a space of 2 to 4 mm from the surface of the photoconductor drum 1.

When the magnetic flux density of the carrier-removing means is less than 400 Gauss, the carrier-removing means has to be disposed at a position closer than 2 mm to the surface of the photoconductor drum 1 to obtain a sufficient carrier-removing effect. In this case, however, there is the risk that the carrier-removing means comes into contact with the photoconductor drum 1 to scratch the surface thereof. On the other hand, when the magnetic flux density of the carrier-removing means is more than 2000 Gauss, the magnetic field with such a large magnetic flux density has such adverse effects that the carrier is caused to be deposited on other members or units near the photoconductor drum 1.

An example of the carrier-removing means for use in the present invention will now be specifically explained.

The carrier-removing means comprises a magnetic member for magnetically attracting a carrier, including a magnetic device, such as a permanent magnet or an excitation-type magnet, a rotary sleeve for protecting the magnetic member and carrying the magnetically attracted carrier thereon, a carrier transportation preventing member for detaching the magnetically attracted carrier from the rotary sleeve, and optionally a carrier recovery coil for discharging the detached carrier from the carrier-removing means and recovering the discharged carrier, if necessary.

Figure 3:
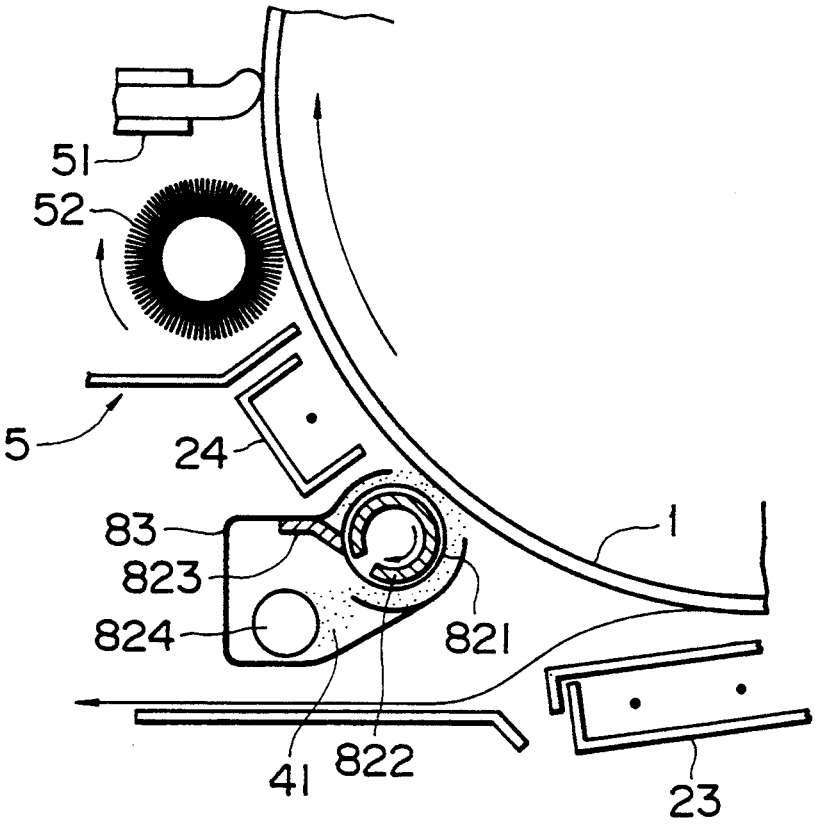
FIG. 3 is a schematic cross-sectional view of an example of carrier-removing means and an example of a cleaning unit for use in the present invention.

With reference to FIG. 3, a specific carrier-removing means 82 will now be explained.

The carrier-removing means 82 is disposed between the transfer sheet separation charger 23 and the cleaning unit 5, more specifically at a position immediately before the cleaning unit 5.

The carrier-removing means 82 comprises (1) a rotatable sleeve 821 with a diameter of 15 to 20 mm, made of a material which cannot be magnetized, such as an aluminum alloy such as duralumin, or plastics, with a thickness of 0.2 to 1 mm, which is not thermally deformed when heated to 60° to 70° C., and has excellent wear resistance and workableness, (2) a carrier-attracting member with an inner magnet 822 (for example, ferrite magnets such as barium ferrite and strontium ferrite, a rubber ferrite comprising a ferrite magnet and a rubber in which the ferrite is dispersed, or MnAl magnet), which is built in the rotatable sleeve 821, or laminated inside the rotatable sleeve 821, and (3) a carrier-transportation preventing member 823 for removing from the sleeve 821 a carrier 41 which is magnetically attracted to the sleeve 821 and causing the removed carrier to fall into the inside of the carrier-removing means 82, thereby preventing the carrier from being transported back to the surface of the photoconductor drum 1.

When the amount of the carrier to be recovered is large, carrier recovering means, for instance, a carrier recovery coil 824 for recovering the carrier 41 while it is rotated, and discharging the carrier may be provided as illustrated in FIG. 3.

The rotatable sleeve 821, which is integrally assembled with the carrier-attracting member with the inner magnet 822, is connected to a driving system through bearing means (not shown), so that the sleeve 821 is rotated either in the same direction as the rotating direction of the photoconductor drum 1 (as shown in FIG. 3) or in the direction opposite to the rotating direction of the photoconductor drum 1.

The carrier-transportation preventing member 823 has the function of removing from the sleeve 821 the carrier 41 which is deposited on the sleeve 821. Therefore the carrier-transportation preventing member 823 can be made of any material so long as it has the above-mentioned function without scratching the surface of the sleeve 821.

In the carrier-transportation preventing member 823 shown in FIG. 3, a plastic film such as a polyethylene terephthalate film, with a thickness of 100 to 200 μm, is used at a portion which comes into contact with the sleeve 821. Alternatively, the carrier-transportation preventing member 823 may be made of a rubber as shown in FIG. 4.

Figure 4:
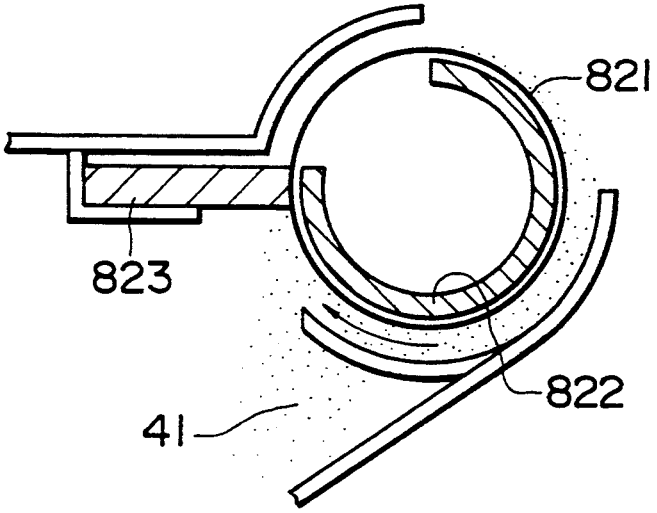
FIG. 4 is a schematic cross-sectional view of another example of carrier-removing means for use in the present invention.

In the carrier-removing means shown in FIG. 4, the magnet 822 is fixed, while only the sleeve 821 is rotated.

When an excitation-type magnet is used as the magnet 822 instead of a permanent magnet such as ferrite magnet, the magnetic force of the magnet 822 can be appropriately adjusted by controlling the voltage or current to be applied to the magnet 822. In this case, it is possible to cause the carrier to fall off the sleeve 821 by deenergizing the magnet 822, although it is still necessary to use the carrier-transportation preventing member 823 since some carrier is physically deposited on the sleeve 821.

It is desirable to provide at least two carrier-removing means 81 and 82 between the development unit 4 and the cleaning unit 5 as shown in FIG. 2 in order to completely remove the carrier from the surface of the photoconductor drum 1. In this case, at least one of the carrier-removing means 81 and 82 must be such a carrier-removing means as shown in FIGS. 3 or 4. In this case, the other carrier-removing means may be a magnet with a magnetic flux density in the range of 400 to 2000 Gauss, such as a ferrite magnet or a samarium-cobalt magnet which is fitted into a frame made of aluminum, copper or stainless steel.

Other features of this invention will become apparent in the course of the following description of exemplary embodiments which are given for illustration of the invention and are not intended to be limiting thereof.

EXAMPLE 1- 1

On an aluminum cylinder with a diameter of 80 mm, a length of 340 mm and a wall thickness of 1 mm, there were successively provided (1) an undercoat layer with a thickness of about 2μm, composed of polyamide resin and $TiO_2$ (made by Ishihara Sangyo Kaisha, Ltd.) dispersed in the polyamide resin, (2) a charge generation layer (CGL) with a thickness of about 0.15μm, composed of polyester resin and a trisazo pigment dispersed in the polyester resin, and (3) a charge transportation layer (CTL) with a thickness of about 28μm, compsoed of polycarbonate (Trademark "Panlite C-1400" made by Teijin, Ltd.) and a stilbene compound dispersed in the polycarbonate, whereby a photoconductor drum was fabricated.

The thus fabricated photoconductor drum was set in a plasma CVD apparatus, and the charge transportation layer was coated with an about 2.0μm thick amorphous carbon film with a Knoop hardness of 600 kg/mm$^2$ under the following conditions:

A $C_2H_4$ gas was introduced with a flow rate of 100 sccm, together with a $NF_3$ gas, into the plasma CVD apparatus. The reaction pressure in the plasma CVD apparatus was set at 0.02 Torr. The FR power (13.56 MHz) employed was 120 W. The film formation rate was about 210 Å/min.

Thus, a function-separated type organic photoconductor drum was fabricated.

The thus fabricated function-separated type organic photoconductor drum was incorporated into a commercially available photographic digital copying machine (Trademark "IMAGIO 420" made by Ricoh Co., Ltd.) which was used as a test machine in this example.

As shown in FIG. 3, carrier-removing means 82 was provided between the transfer sheet separation charger 23 and the cleaning unit 5.

As the magnet 822 for the carrier-removing means 82, four half-cylinder-shaped magnets were made, by dividing each of two hollow cylinders with a wall thickness of 3 mm, a diameter of 18 mm, and a length of 150 mm into two in the axial direction of the cylinder. These four magnets were fixed by an adhesive agent along the inside wall of an aluminum cylinder with a wall thickness of 1 mm, a length of 330 mm, and an inner diameter of 18.3 to 18.5 mm, whereby an inner-magnets-built-in carrier-removing cylindrical unit was made. The magnetic flux density of the magnets in this carrier-removing cylindrical unit was about 1000 Gauss. This carrier-removing cylindrical unit was made rotatable by attaching bearings on the opposite ends thereof.

As the carrier-transportation preventing member 823, a carrier-transportation preventing member was fabricated by applying a polyethylene terephthalate film with a thickness of about 200 μm (Trademark "Lumirror" made by Toray Industries, Inc.) to a phosphor bronze plate with a thickness of 0.2 mm with an edge of the polyethylene terephthalate film extending by a length of about 5 mm over the phosphor bronze plate in such a manner that the extended edge of the polyethylene terephthalate film comes into contact with the surface of the carrier-removing cylindrical unit to remove the carrier therefrom.

In this test machine, a carrier discharging device was not provided, but a carrier discharging outlet was provided. The inner-magnets-built-in carrier-removing cylindrical unit was rotated at about 50 rpm.

With the initially charged potential of the photoconductor drum in this test machine set at −700 volts, and with the potential of an image area set at −200 volts, a copy making test was conducted by making 40,000 copies by using a two-component developer comprising a carrier and a toner to see the formation of scratches on the surface of the photoconductor drum and black lines in developed images, and the entering of the carrier between the photoconductor drum and the cleaning blade.

The result was that no scratches were formed on the surface of the photoconductor drum, no black lines were formed in the developed images in any of the copies, and there was no entering of the carrier between the cleaning blade and the photoconductor drum at the completion of the above copy making test.

EXAMPLE 1-2

A photoconductor drum was fabricated in the same manner as in Example 1-1 and was set in a plasma CVD apparatus, and the charge transportation layer was coated with an about 1.3 μm thick amorphous carbon film with a Knoop hardness of 420 kg/mm$^2$ under the following conditions:

A $C_2H_4$ gas was introduced with a flow rate of 100 sccm, together with a $NF_3$ gas, into the plasma CVD apparatus. The reaction pressure in the plasma CVD apparatus was set at 0.03 Torr. The FR power (13.56 MHz) employed was 120 W. The film formation rate was about 210 Å/min.

Thus, a function-separated type organic photoconductor drum was fabricated.

The thus fabricated function-separated type organic photoconductor drum was incorporated into the same test machine as that used in Example 1-1. With the initially charged potential of the photoconductor drum in this test machine set at −700 volts, and with the potential of an image area set at −200 volts in the same manner as in Example 1, a copy making test was conducted by making 40,000 copies by using the same two-component developer as that used in Example 1-1 to see the formation of scratches on the surface of the photoconductor drum and black lines in developed images, and the entering of the carrier between the photoconductor drum and the cleaning blade.

The result was that no scratches were formed on the surface of the photoconductor drum, no black lines were formed in the developed images, and there was substantially no entering of the carrier between the cleaning blade and the photoconductor drum at the completion of the above copy making test.

COMPARATIVE EXAMPLE 1-1

The procedure for Example 1-1 was repeated except that the carrier-removing means employed in Example 1 was removed from the test machine. The same copy making test as in Example 1-1 was repeated.

The result was that countless scratches with a width of about 80 μm and a depth of about 100 μm were formed on the surface of the photoconductor, two lines were formed in halftone image areas, and the entering of the carrier between the photoconductor drum and the cleaning blade actually took place at the completion of the above copy making test.

COMPARATIVE EXAMPLE 1-2

The procedure for Example 1-2 was repeated except that the carrier-removing means employed in Example 1-2 was removed from the test machine. The same copying making test as in Example 1-2 was repeated.

The result was that 10 to 15 scratches were formed on the surface of the photoconductor, three black lines were formed in half-tone image areas, and the entering of the carrier between the photoconductor drum and the cleaning blade actually took place at the completion of the above copy making test.

COMPARATIVE EXAMPLE 1-3

The procedure for Example 1-2 was repeated except that the rotation of the carrier-removing means employed in Example 1-2 was stopped. The same copy making test as in Example 1-2 was repeated.

The result was that countless scratches were formed on the surface of the photoconductor, eight black lines were formed in half-tone image areas, and the entering of the carrier between the photoconductor drum and the cleaning blade actually took place at the completion of the above copy making test.

A large amount of the carrier accumulated on the sleeve of the carrier-removing means and a lump of the carrier was found to be deposited on the cleaning blade.

Furthermore, a large amount of scrapings from the photoconductor drum was found particularly in the circumferential direction of the photoconductor drum.

EXAMPLE 2-1 AND COMPARATIVE EXAMPLE 2-1

The same function-separated type organic photoconductor drum as used in Example 1-2 was fabricated except that the thickness of the amorphous carbon film serving as the protective layer for the charge transportation layer was increased to about 2.2 μm.

The thus fabricated function-separated type organic photoconductor drum was incorporated into the same commercially available photographic digital copying machine (Trademark "IMAGIO 420" made by Ricoh Co., Ltd.) used as the test machine in Example 1-2.

Furthermore, a ferrite magnet with a magnetic flux density of about 1400 Gauss was incorporated in the above test machine at a position corresponding to a position near the transfer sheet separation pawl 25 in FIG. 3, instead of the carrier-removing means employed in Example 1-2, in such a configuration that a tip of the magnet was directed toward the surface of the photoconductor drum and the magnet was extended up to about a half of the photoconductor drum in the axial direction thereof, with a space of about 2.5 mm maintained between the magnet and the surface of the photoconductor drum and with a development bias potential set at −600 volts.

With the initially charged potential of the photoconductor drum in this test machine set at −820 volts, and with the potential of an image area set at −220 volts, a copy making test was conducted by continuously making 5,000 copies per day, total 40,000 copies, by using a two-component developer comprising a carrier and a toner to see the formation of scratches on the surface of the photoconductor drum and black lines in developed images, and the entering of the carrier between the photoconductor drum and the cleaning blade.

After the completion of the above copy making test, the surface of the photoconductor drum was inspected. The result was that there were no scratches in the half portion of the photoconductor drum covered by the ferrite magnet except very slight scratches formed by the transfer sheet separation pawl, and accordingly no black lines were formed in the copies, while in the other half portion of the photoconductor drum which was not covered by the ferrite magnet, 10 and several scratches with a width of about 20 to 50 μm and a depth of about 2000 Å to 5 μm were found, and several black lines were found to be formed in the corresponding portions.

EXAMPLE 2-2 and Comparative Example 2-2

The same function-separated type organic photoconductor drum as used in Example 2-1 was incorporated into the same test machine as used in Example 2-1, and a ferrite magnet with a magnetic flux density of about 800 Gauss was incorporated in the above test machine at the same position as in Example 2-1, in such a configuration that a tip of the magnet was directed toward the surface of the photoconductor drum and about a half of the photoconductor drum was covered by the magnet in the axial direction of the photoconductor drum, with a space of about 2 mm maintained between the magnet and the surface of the photoconductor drum and with a development bias potential set at −600 volts.

With the initially charged potential of the photoconductor drum in this test machine set at −700 volts, and with the potential of an image area set at −180 volts, a copy making test was conducted by continuously making 5,000 copies per day, and total 40,000 copies, by using the same two-component developer as used in Example 2-1 to see the formation of scratches on the surface of the photoconductor drum and black lines in the images, and the entering of the carrier between the photoconductor drum and the cleaning blade.

After the completion of the above copy making test, the surface of the photoconductor drum was inspected. The result was that there were no scratches in the half portion of the photoconductor drum covered by the ferrite magnet except very slight scratches formed by the transfer sheet separation pawl, and accordingly no black lines were formed in the copies, while in the other half portion of the photoconductor drum which was not covered by the ferrite magnet, 5 to 6 scratches were found.

COMPARATIVE EXAMPLE 2-3

The same function-separated type organic photoconductor drum as used in Example 2-1 was incorporated into the same test machine as used in Example 2-1, and a rubber ferrite magnet with a magnetic flux density of about 300 Gauss was incorporated in the above test machine at the same position as in Example 2-1, in such a configuration that a tip of the magnet was directed toward the surface of the photoconductor drum and about a half of the photoconductor drum was covered by the magnet in the axial direction of the photoconductor drum, with a space of about 2 mm being maintained between the magnet and the surface of the photoconductor drum and with a development bias potential set at −600 volts.

With the initially charged potential of the photoconductor drum in this test machine set at −700 volts, and with the potential of an image area set at −180 volts, a copy making test was conducted by continuously making 5,000 copies per day, total 40,000 copies, by using the same two-component developer as used in Example 2- 1 to see the formation of scratches on the surface of the photoconductor drum and black lines in the images, and the entering of the carrier between the photoconductor drum and the cleaning blade.

After the completion of the above copy making test, the surface of the photoconductor drum was inspected. The result was that there were 2 to 3 scratches in the half portion of the photoconductor drum covered by the rubber ferrite magnet, and in the other half portion of the photoconductor drum which was not covered by the rubber ferrite magnet, 7 to 8 scratches were found.

The above results indicate that the rubber ferrite magnet employed in this example did not have a sufficient carrier removing effect for use in practice.

EXAMPLE 2-3

The same function-separated type organic photoconductor drum as used in Example 2-1 was incorporated into the same test machine as used in Example 2-1, and a rubber ferrite magnet with a magnetic flux density of about 1500 Gauss was incorporated in the above test machine at the same position as in Example 2-1, in such a configuration that a tip of the magnet was directed toward the surface of the photoconductor drum and the photoconductor drum was covered in its entirety by the magnet in the axial direction of the photoconductor drum, with a distance of about 2.5 mm being maintained between the magnet and the surface of the photoconductor drum and with a development bias potential set at −600 volts.

With the initially charged potential of the photoconductor drum in this test machine set at −730 to −750 volts, and with the potential of an image area set at −200 volts, a copy making test was conducted by continuously making 5,000 copies per day, total 80,000 copies, by using the same two-component developer as used in Example 2-1 to see the fromation of scratches on the surface of the photoconductor drum and black lines in the images, and the entering of the carrier between the photoconductor drum and the cleaning blade.

After the completion of the above copy making test, the surface of the photoconductor drum was inspected. The result was that there was only one scratch in the photoconductor drum except some slight scratches were considered to be formed by the transfer sheet separation pawl, and the scratches did not have any adverse effects on the image quality obtained. A large amount of the carrier was found to be deposited on the magnet.

The above results indicate that the above ferrite magnet employed in this example did have a sufficient carrier removing effect for use in practice.

As can be seen from the above, the deposition of a carrier on the surface of the photoconductor has the above-mentioned adverse effects on the image quality obtained because of the scratches formed by carrier on the photoconductor. The formation of such scratches on the photoconductor can be prevented to some extent by providing a protective layer on the photoconductor, but a protective layer that can be used in practice has as thin as 1 to 5μm, so that the formation of scratches cannot be completely avoided.

According to the present invention, the above problems can be solved by providing at least one carrier removing means with a magnetic flux density of about 400 to 2000 Gauss between a development step and a cleaning step in the electrophotographic image formation method.

What is claimed is:

1. In an electrophotographic image formation method, comprising the steps of:

uniformly charging a photoconductor to a predetermined polarity, said photoconductor comprising an electroconductive support, an organic photoconductive layer formed on said electroconductive support, and a protective layer comprising carbon formed on said organic photoconductive layer, applying a digitally-processed light image to said photoconductor, with the potential of an image area of an original image being reversed with respect to the potential of a non-image area of said original image, thereby forming a latent electrostatic image corresponding to said original image on said photoconductor, performing reverse development of said latent electrostatic image formed on said photoconductor by use of a two-component developer comprising a carrier and a toner to form a visible toner image on said photoconductor, performing an image transfer of said visible toner image formed on said photoconductor, attracting said carrier, after performing said image transfer, using at least one carrier removing means for attracting said carrier with a magnetic flux density in the range of from 400 Gauss to 2000 Gauss prior to cleaning said photoconductor, and cleaning said photoconductor after said step of attracting said carrier.

2. The electrophotographic image formation method as set forth in claim 1, further comprising the step of:

positioning said at least one carrier removing means in the range of from 2 mm to 5 mm from the surface of said photoconductor.

3. The electrophotographic image formation method as set forth in claim 2, wherein said step of attracting said carrier includes using a magnetic flux density in the range of from 600 Gauss to 1500 Gauss.

4. The electrophotographic image formation method as set forth in claim 1, wherein said step of attracting said carrier includes using a magnetic flux density in the range of from 600 Gauss to 1500 Gauss.

5. In an electrophotographic image formation method, comprising the steps of:

uniformly charging a photoconductor drum to a predetermined polarity, said photoconductor drum comprising an electroconductive support, an organic photoconductive layer formed on said electroconductive support, and a protective layer comprising carbon formed on said organic photoconductive layer, applying a digitally-processed light image to said photoconductor drum, with the potential of an image area of an original image being reversed with respect to the potential of a non-image area of said original image, thereby forming a latent electrostatic image corresponding to said original image on said photoconductor drum, performing reverse development of said latent electrostatic image formed on said photoconductor drum by use of a two-component developer comprising a carrier and a toner to form a visible toner image on said photoconductor drum, performing an image transfer of said visible toner image formed on said photoconductor drum, attracting said carrier, after performing said image transfer, using at least one carrier removing means for attracting said carrier with a magnetic flux density in the range of from 400 Gauss to 2000 Gauss prior to cleaning said photoconductor drum, and cleaning said photoconductor drum after said step of attracting said carrier.

6. The electrophotographic image formation method as set forth in claim 5, further comprising the step of:

positioning said at least one carrier removing means in the range of from 2 mm to 5 mm from the surface of said photoconductor drum.

7. The electrophotographic image formation method as set forth in claim 6, wherein said step of attracting said carrier includes using a magnetic flux density in the range of from 600 Gauss to 1500 Gauss.

8. The electrophotographic image formation method as set forth in claim 5, wherein said step of attracting said carrier includes using a magnetic flux density in the range of from 600 Gauss to 1500 Gauss.

* * * * *